US005249808A

United States Patent [19]

Batté

[11] Patent Number: 5,249,808

[45] Date of Patent: Oct. 5, 1993

[54] BOARD GAME APPARATUS

[75] Inventor: Ruth L. Batté, Pataskala, Ohio

[73] Assignee: James B. Tarpoff, Pataskala, Ohio

[21] Appl. No.: 790,191

[22] Filed: Nov. 7, 1991

[51] Int. Cl.[5] ..... A63F 3/00

[52] U.S. Cl. ..... 273/249; 273/DIG. 27; 273/146

[58] Field of Search ..... 273/242, 243, 248, 249, 273/250, 251, 252, 254, 258, 146, DIG. 27; 434/167, 128, 129

[56] References Cited

U.S. PATENT DOCUMENTS

| | | | |
|---|---|---|---|
| 1,077,865 | 11/1913 | Atkins | 273/243 |
| 1,480,360 | 1/1924 | Agee, Jr. | 273/249 |
| 1,707,323 | 4/1929 | Schaffer . | |
| 1,797,742 | 3/1931 | Ward . | |
| 2,729,451 | 1/1956 | Larson | 273/146 |
| 2,745,667 | 5/1956 | Graham | 273/134 |
| 2,852,260 | 9/1958 | Caffrey | 273/134 |
| 3,033,572 | 5/1962 | Thibault | 273/243 |
| 3,115,345 | 12/1963 | De Temple | 273/134 |
| 3,815,919 | 6/1974 | Cain | 273/134 |
| 4,035,932 | 7/1977 | Massey | 434/167 X |
| 4,042,245 | 8/1977 | Zarour | 273/134 |
| 4,090,717 | 5/1978 | Rossetti | 273/134 |
| 4,116,450 | 9/1978 | Darrell | 273/134 |
| 4,643,430 | 2/1987 | D'Aloia | 273/252 |
| 4,743,025 | 5/1988 | Gramera | 273/146 |
| 4,877,254 | 10/1989 | Yuscavage | 273/146 X |
| 4,927,147 | 5/1990 | Delzio | 273/146 |
| 4,930,788 | 6/1990 | Roccanova | 273/146 X |
| 5,031,915 | 7/1991 | Sanditen | 273/146 |

FOREIGN PATENT DOCUMENTS

| | | | |
|---|---|---|---|
| 2738798 | 3/1979 | Fed. Rep. of Germany | 273/249 |

*Primary Examiner*—V. Millin
*Assistant Examiner*—William E. Stoll
*Attorney, Agent, or Firm*—Robert E. Stebens

[57] ABSTRACT

A board game apparatus is provided having a game board on which a pathway is formed and over which playing pieces of respective players are incrementally advanced from a start point to an end point. The pathway includes a plurality of playing spaces serially distributed along the pathway between the start and end points with the playing pieces advanced to a playing space as determined by a random selection of the space to which a player is to advance his playing piece. Each playing space is defined by two discrete indicia that are each selected from respective ones of two indicia series that each include a plurality of diverse indicia with all indicia in each series being distinguishable from all indicia in the other series. The playing spaces are randomly interspersed along the pathway to avoid having same playing spaces disposed adjacent each other. Selection of the playing space to which a player's playing piece is to be advanced is determined by random manipulation of two independent selector devices that function to select one indicia out of each indicia series upon operation by a player, each selector device with a respective one of the indicia series.

17 Claims, 5 Drawing Sheets

BOARD GAME APPARATUS

FIELD OF THE INVENTION

This invention relates in general to an amusement device in the form of a board game over which playing pieces are advanced by respective players in accordance with devices that determine the extent of incremental advancement. It relates more particularly to a board game apparatus having a pathway incorporating a plurality of serially arranged playing spaces that are defined by at least two discrete indicia and indicia selection devices which are operable to effect the random selection indicia to determine the two diverse indicia that will define the space to which a player may next advance his playing piece.

BACKGROUND OF THE INVENTION

Game boards of a general type having one or more pathways provided on a playing surface and over which a player advances a respective playing piece in accordance with devices to select and determine the extent of advancement have been devised and placed in common use for a number of years. Such game boards that have been devised and in use are generally characterized as being of a type having a pathway which is formed of or defined by a number of spaces that are arranged in sequence and usually define a predetermined surface area onto which a playing piece may be positioned to determine the extent of progress of the player in playing of the game. The most common techniques employed in functioning of such previously existing game board apparatus is a numerical determination of the number of spaces which may be traversed by a particular playing piece at any one player's turn in playing of the game. The determination of the number of spaces which a player may advance a playing piece is frequently determined by random selection devices such as either the common numerical-type die or by spinner mechanisms that provide a numerical indication. While some of these game boards also incorporate other features to enhance the complexity and create greater interest in playing of the game such as having spaces which provide for penalties in the form of reverse movement or perhaps have bonus grants in the nature of enabling the player to move his playing piece a greater number of spaces than that which is indicated by the random selector device. Regardless of the added features that may be incorporated in a particular game, these prior game devices operate on the common basic principle of a playing piece being advanced a certain number of spaces for each player's turn as determined by a random selector device and they are thus characterized as being strictly a numerical type device. As such, the basic playing technique requires the player to count the spaces and to then move the playing piece to the appropriate new space.

While the board game apparatus of this described type provides amusement and, in some cases, can also be educational, even a simple form of the game apparatus having numerical determination of the advancement of a playing piece cannot be used by relatively young children or by those with learning disabilities. A numerical system for determining the number of spaces that a playing piece may be advanced may well exceed the capabilities of young children and may not be comprehensible by those with learning disabilities. Consequently, numerical based board game apparatus are either unusable by certain categories of persons or their difficulty effectively negates the enjoyment aspect.

SUMMARY OF THE INVENTION

In accordance with this invention, a board game apparatus is provided having a pathway formed on a playing surface and over which playing pieces are advanced to determine the progress of a player's playing piece from a starting to an end position. The pathway includes a plurality of playing spaces which are arranged in series with each of the playing spaces being identified by two discrete indicia and advancement of the playing piece is determined by random indicia selection devices with two such selection devices being provided and each operable to effect the random selection of a respective one of the two indicia that define a playing space. Each of the two indicia that define a playing space are from a respective indicia series with two such series of indicia being provided and each having a plurality of different or diverse indicia. With the two series of indicia, the playing spaces are thus defined to provide variations as between combinations of indicia from the two series and with the combinations then being randomly disbursed or spaced along the pathway such that there will be a variation as between the particular adjacent playing spaces. In a first embodiment of the invention, the two series of indicia are respectively formed of geometrical shapes and of colors with a relatively simple embodiment including three geometrical shapes in the one series and three colors in the second series. The random indicia selecting devices in this basic embodiment are a pair of cube-shaped die having one die associated with each of the respective indicia series and having the geometrical shapes formed on surfaces of the one die and the surfaces of the other die provided with the different colors on different faces. A player throwing the die determines a space to which a playing piece may be advanced by the combination of the geometrical shape and the color. Thus, the game apparatus of this invention requires only the visual association of two factors by a player and does not require any numerical capability for determining the number of spaces over which the playing piece may be advanced. This apparatus, because of the simplicity of merely visually associating two factors, is of particular advantage and usefulness for players who are of either relatively few years or who may be subject to learning disabilities.

A second embodiment of the board game apparatus of this invention utilizes the same general principles of two factors for determining advancement of a playing piece, but is uniquely adapted for use by visually impaired persons. This second embodiment of the apparatus also has a pathway formed with playing spaces that are each defined by two discrete indicia and movement of the playing piece is determined by the random functioning of selector devices such as a pair of cubical die. In this particular version, however, the indicia are of a three dimensional configuration to enable a player to determine by tactile sensing the respective indicia that are displayed by the die as well as determining by tactile sensing the playing space onto which the playing piece is to be advanced. The one series of indicia may again be geometrical patterns of a very basic and distinctive form while the second indicia series is formed by diverse surface texturing that is applied to the playing spaces and also to the faces of the selector die. This second embodiment of a board game apparatus thus functions in essentially the same manner as the first embodiment and is again adapted to use by relatively young persons and, in particular, to those who are visually impaired.

These and other objects and advantages of this invention will be readily apparent from the following detailed description of embodiments thereof and the accompanying drawings.

DESCRIPTION OF THE DRAWING FIGURES

DETAILED DESCRIPTION OF THE ILLUSTRATIVE EMBODIMENTS

Figure 1:
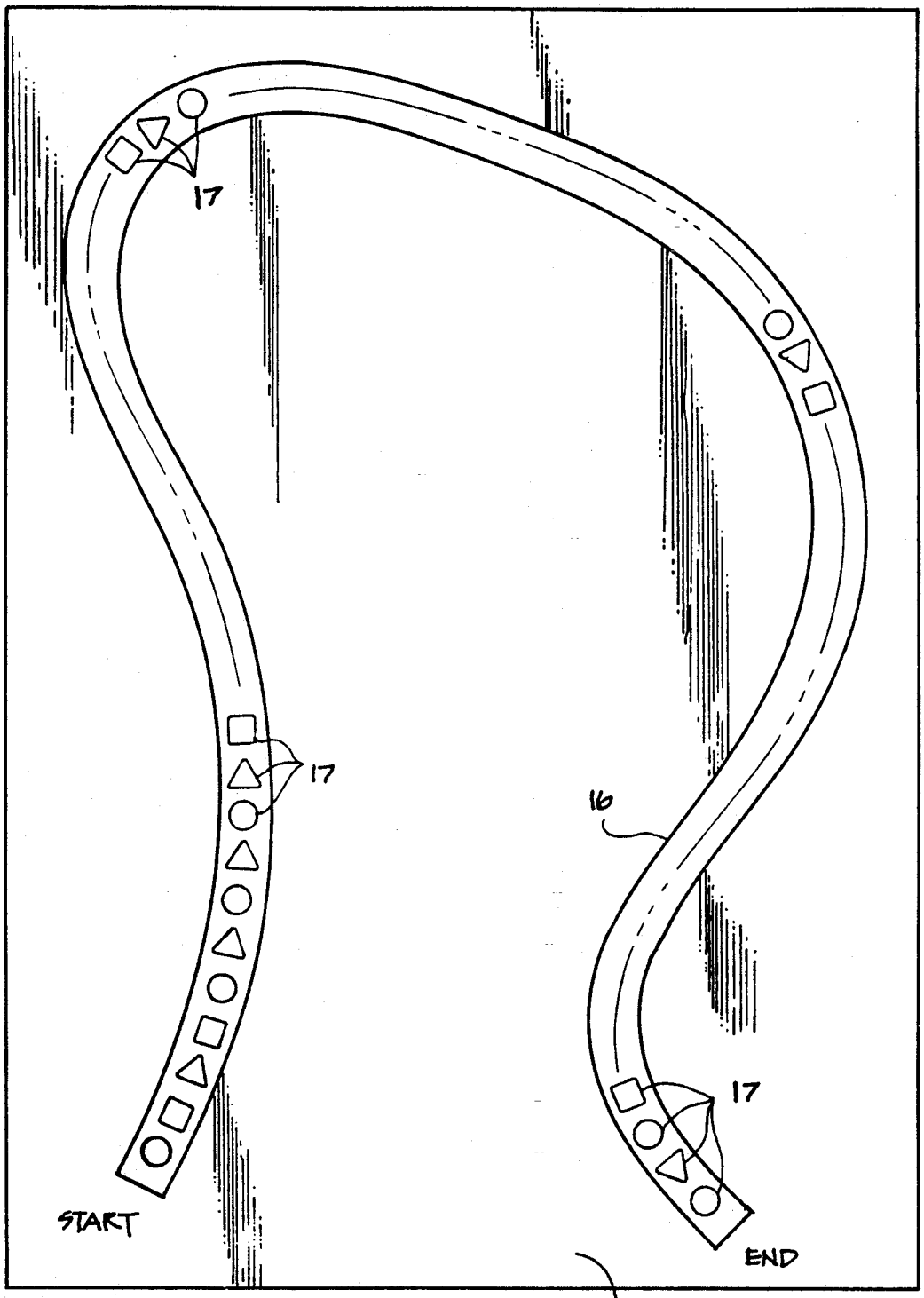
FIG. 1 is a top plan view of a game board formed in accordance with a first embodiment of this invention.

Referring to the drawings, particularly FIGS. 1–5, the several components of a first embodiment of the game board apparatus are shown in detail. These components include, as is shown in FIG. 1, a game board 10, two playing pieces 11 and 12 shown in FIGS. 2 and 3 and two die 13 and 14 shown in FIGS. 4 and 5 that comprise the indicia selection means. The game board 10 is formed from a sheet of material having an upper surface 15 on which a pathway 16 is formed and over which the playing pieces 11 and 12 are caused to move in the ordinary sequence of progression of the game. This pathway 16 may be of any desired configuration or graphical design that may be deemed aesthetically appropriate. Its configuration does not effect the functioning of the inventive aspects of this game apparatus and is to perform its function of providing a line of movement for the playing pieces from a start to an end point. Depending upon the size and the portability characteristics desired for the apparatus, the board 10 may be fabricated from a rigid sheet of material and provided with hinged sections to enable it being folded to a smaller and more compact configuration for purposes of storage or it may be fabricated from a sheet of flexible material such as heavy paper or plastic material that may also be folded or rolled into a compact configuration. For aesthetic purposes, the upper surface 15 may be of a color and it may also be provided with graphic designs to enhance appearance with the graphic designs perhaps having some relationship to particular features of the game or to the persons who may be utilizing the game.

Figure 1A:
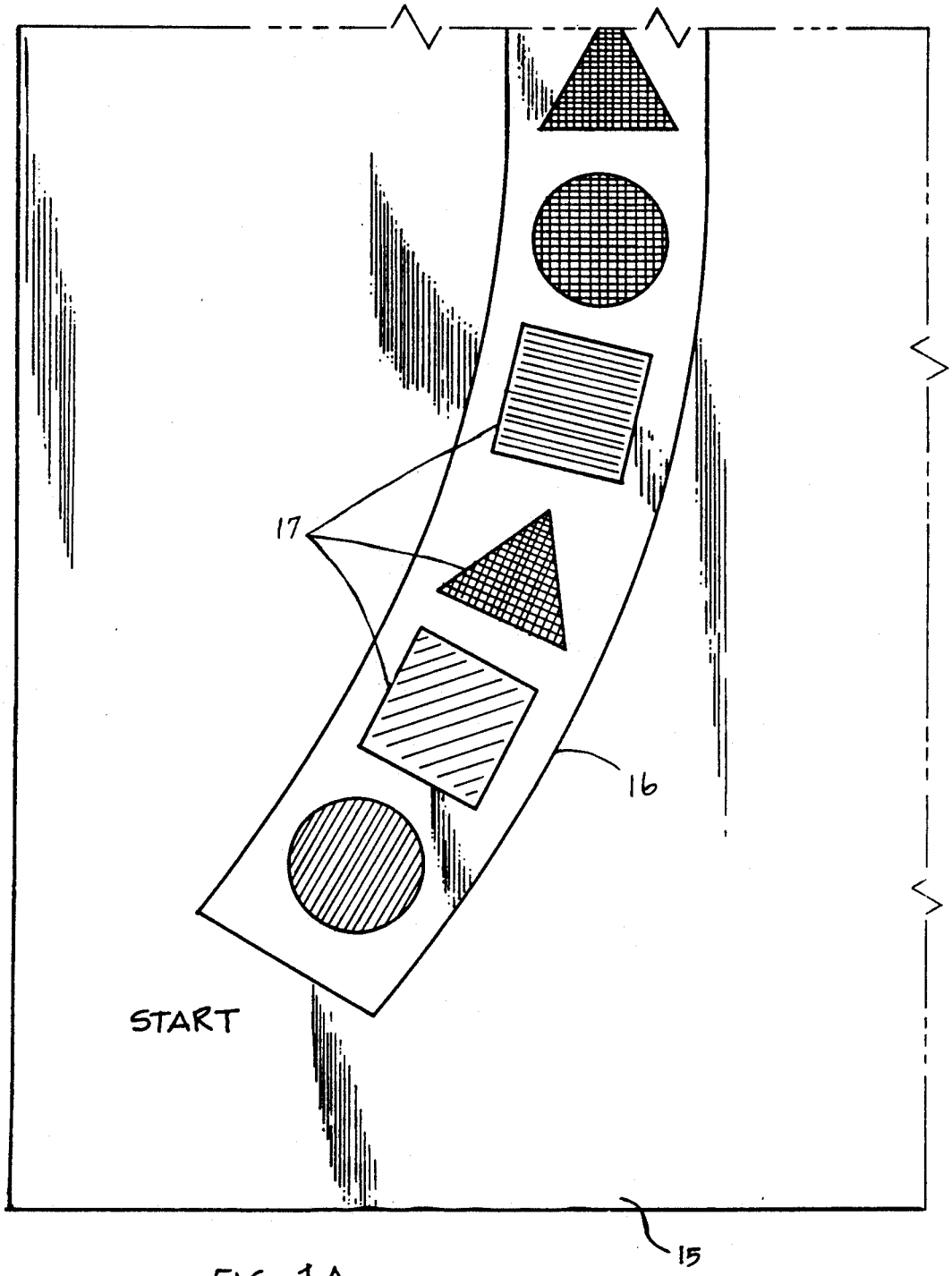
FIG. 1A is a fragmentary portion of the game board of FIG. 1, but on an enlarged scale.

A plurality of playing spaces 17 are provided along this pathway. The playing spaces are distributed in serial relationship along the pathway and as can be seen in FIGS. 1 and 1A, are advantageously spaced apart from each other to assure that they will retain their visual distinctiveness. Each of these spaces 17 is defined by two discrete indicia with the indicia being selected from a plurality of diverse indicia that are included in each of two respective indicia series. A first of the two indicia series includes a plurality of different basic geometric shapes which, in this illustrative embodiment, comprise a square, a triangle and a circle. The second of the indicia series comprises a plurality of different colors which, in this illustrative embodiment, are yellow, blue and red. As can be seen in FIGS. 1 and 1A, the playing spaces as defined by the geometric configurations of the first indicia series are randomly arranged to further enhance the variability encountered during the course of play. Similarly, the color indicia of the second indicia series is also randomly applied to the geometric figures in a manner to preferably avoid any two adjacent playing spaces having the same visual appearance, i.e. having the same two types of indicia. In this embodiment with three diverse indicia in each indicia series it is possible to have nine playing spaces in series sequence without repetition of the duplicate indicia on any one of those spaces. However, the placement of the indicia is a matter of preference and it is not objectionable to have a repetition of a particular space more often than nine spaces or, for that matter, an adjacent pair of spaces may comprise identical sets of indicia.

Determination of the advancement of the playing piece for a particular player during the course of progression of the game is determined by the operation of the pair of die 13 and 14. Each die is designed to be associated with a respective one of the first and second indicia series. In this embodiment, the die 13 is associated with the geometric shape indicia with the die 14 being associated with the indicia series comprising the different colors. Each die is of a cubical shape with the die 13 having the different geometric shapes graphically illustrated on respective faces of the die. This can be conveniently effected by painting the geometric figures on those faces. It is not necessary that the geometric shapes be shown in any specific color and it is best that they do not appear in the colors that comprise the second indicia series. The second die 14 has the several faces painted with the three different colors. In this embodiment which utilizes three diverse indicia in each series, only three faces of a die are required to display the set of indicia. However, it is advantageous to also apply the indicia to opposed faces of a die so that all six faces are provided with indicia. This will avoid having a die otherwise come up with a blank face and require the player to again throw the die to obtain a determination of the movement of a playing piece.

Figure 3:
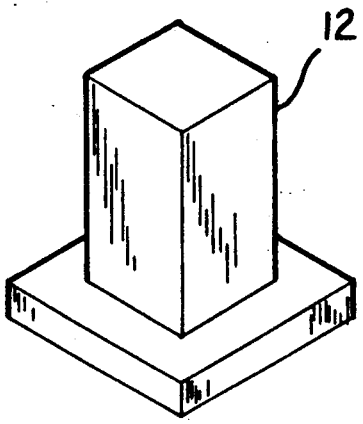
FIGS. 2 and 3 are perspective views of two differently configured playing pieces for utilization with the inventive game apparatus.
Figure 2:
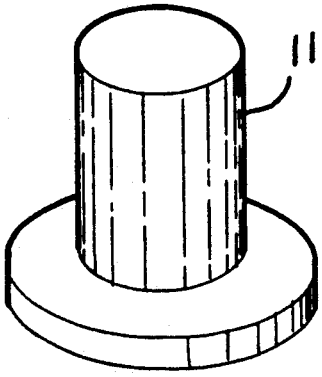
Figure 4:
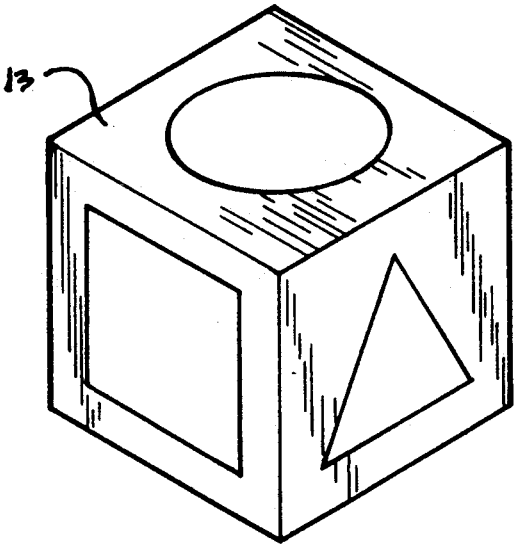
FIG. 4 is a perspective view of one of the die having the diverse indicia of a first indicia series.
Figure 5:
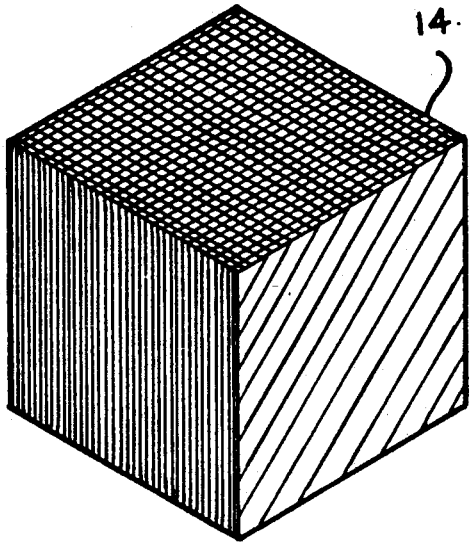
FIG. 5 is a perspective view of a second die provided with the indicia of a second indicia series.

Each player participating in a game is provided with a respective playing piece such as 11 or 12 that is identifiable with a respective player. This game can be played by a single individual, however, the enjoyment aspects is obviously greater if two or more players participate in a game. The number of players is not restricted to two players and if more players are to participate, then additional playing pieces with specific identification to a particular player would necessarily be provided. The identification function of a playing piece can be achieved by geometric shapes such as those which are illustrated in FIGS. 2 and 3. However, the playing pieces may be of a same configuration and merely be painted with a distinctive color or color scheme. The distinct geometric configurations are of advantage for use with the second embodiment of the invention which will be subsequently described and the reason therefor will be readily understood.

Playing of the board game apparatus should be readily apparent from the description of the components and their structural features, but, in general, the game proceeds on the basis of the players in sequence rolling the pair of die to obtain an indication of each of the two indicia in their respective indicia series. The selected indicia will be that which appears on the top face of the die when they come to rest. The player then advances his respective playing piece to the next space that is identified by the two indicia. The next and subsequent players then, in turn, roll the die to determine the respective advancement of their playing piece. This continues then until the players reach the end point with the first to reach being determined as the ultimate winner of a particular game. Other rules of play may be devised depending upon the degree of complexity that is desired for the particular group of participants. For example, rules can be devised whereby the situation of two participants ending on a same playing space resulting in the second to arrive being disqualified in its turn of play or having to place the playing piece on a last preceding space identified by the same two indicia factor. As previously indicated, this board game apparatus is designed for utilization by relative young players or by those having learning disabilities. Accordingly, it may not be appropriate to have complex rules governing certain aspects of play that are often associated with board game apparatus of this general type. It is this factor of simplicity that has also dictated the simplicity of the configuration of the pathway. Many board game apparatus with pathways have the pathway arranged and configured so that it crosses itself at one or more points to increase and enhance the aspect of variability in play. This could also be done with this apparatus if it is deemed appropriate for the particular participants to which it may be directed or intended to be utilized.

Figure 6:
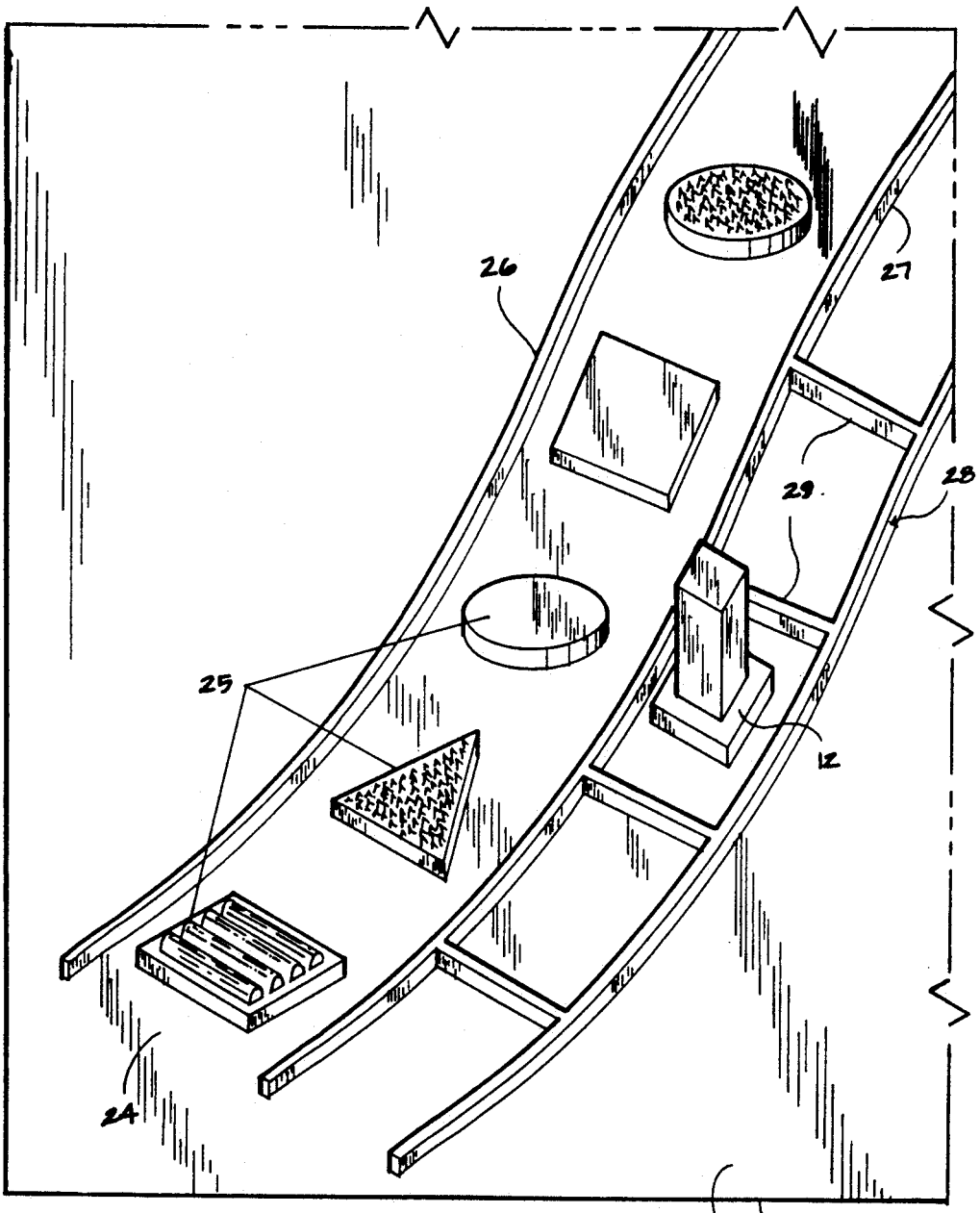
FIG. 6 is a perspective view of a portion of a game board constructed in accordance with the second or tactile embodiment of this invention.
Figure 7:
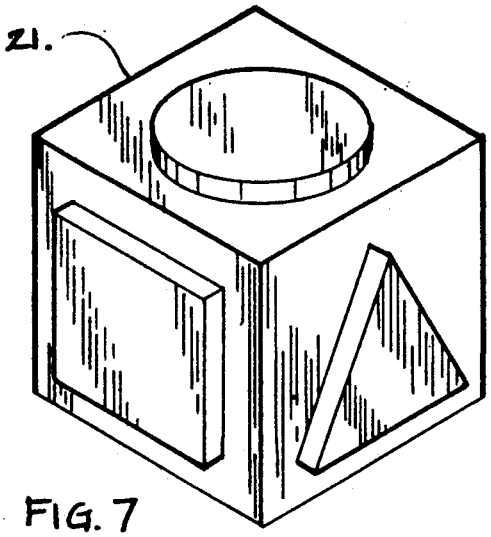
FIG. 7 is a perspective view of an indicia selector die for the tactile embodiment provided with the diverse indicia of a first indicia series.
Figure 8:
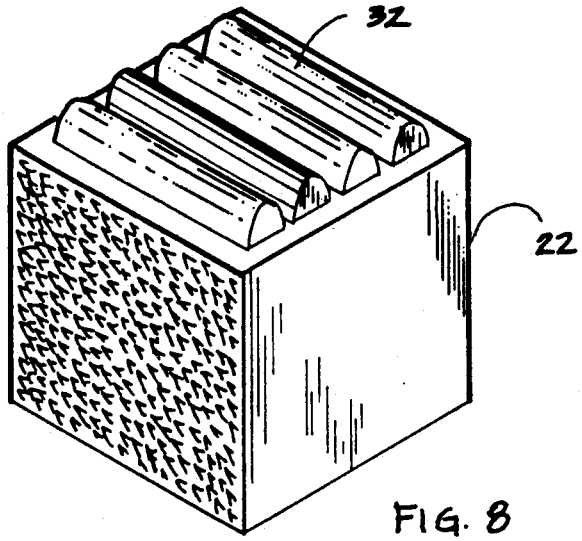
FIG. 8 is a perspective view of a second die for the tactile embodiment showing the diverse indicia of a second indicia series.

The second embodiment of the inventive apparatus is designed for utilization by participants who are visually impaired and are not able to discern the visual graphical designs of the geometric shapes or to ascertain the respective colors that are associated with the two indicia series. This second embodiment of the board game apparatus which has the components thereof shown in FIGS. 6, 7 and 8 is a tactile version wherein the participants determine the indicia by touching with the fingers as the indicia are formed in a three-dimensional configuration. This second embodiment of the apparatus includes a game board 20 of which only a fragmentary portion is shown in FIG. 6 and a pair of die 21 and 22 shown in FIGS. 7 and 8. The same symbolism of the indicia is retained in the second embodiment as the one indicia series consists of a plurality of geometric shapes with the second series having surface texturing which is emulative of the color feature of the first embodiment.

The game board 20 comprises a sheet-form structure having an upper surface 23 on which a pathway 24 is formed. Included in this pathway are a plurality of playing spaces 25. As in the case of the first embodiment, each playing space 25 is defined by two different indicia that are each selected from a respective one of first and second indicia series. These indicia are selected on the basis of providing a tactile distinction as between adjacent playing spaces with three indicia included in each series, thus providing nine different combinations. In this tactile version, the game board may also be advantageously provided with a guide rib 26 which projects a distance upwardly from the upper surface 23 and enables a participant to more easily determine the location of the pathway and facilitate following of the series of playing spaces. This guide rib 26 generally parallels and follows the longitudinal axes of the several playing spaces and is positioned laterally at a distance that is convenient for the participant to follow the pathway and to concurrently sense the configuration and surface featuring of the respective playing spaces to determine the position to which a playing piece is to be advanced. In this tactile version, it is advantageous that the playing pieces not be positioned on the top of a playing space as that would interfere with a subsequent participant's ability to sense and detect the identification of a playing space. Accordingly, a second guide path may be provided with a pair of upstanding guide rails 27 and 28 formed on the upper surface of the playing board with the playing pieces adapted to be disposed between these ribs and thus better retained in their attained positions. Other mechanisms may be utilized to assure maintenance of the playing pieces in an attained position, such as sockets configured to cooperatively receive the base of the playing piece. These sockets may be formed by upstanding rib elements extending transversely between the longitudinal rails 27 and 28 at locations intermediate adjacent pairs of playing spaces.

In this second embodiment, the first indicia series comprises a plurality of geometric shapes which again consist of a square, a circle and a triangle, thereby retaining the same three differences in the indicia. The geometrical configurations are formed in three dimensions on the game board as well as on the side faces of the die 21. Thus, the participants can ascertain the geometric shape that appears on the top face of a die once it has been thrown and to then correlate it with the three-dimensional same configuration of that geometric shape of the playing spaces that appear on the game board. The second indicia series comprises the texture characteristic which is applied to respective faces of the die 22 shown in FIG. 8 as well as to the upper surfaces of the playing spaces 25. This textured surfacing is illustrated in this embodiment as comprising a smooth surface 30, a plush textile surface 31 and a ribbed configuration 32. Again, as in the case of the first embodiment, these surface features of each of the die 21 and 22 may be repeated on opposed surfaces in order that it will not be necessary for the participant to re-roll a die in the case of a face showing up that does not have an indicia configuration, either geometric or texture. This is necessary in this case where the one tactile face feature is a smooth surface.

Utility of the specific and different geometrical configurations of playing pieces as shown in FIGS. 2 and 3 will be apparent with respect to this second embodiment of the apparatus. Different geometric shapes provide a tactile distinction that permits tactile identification by participants with visual impairment.

While the tactile version of the board game apparatus of this invention is intended for use by vision-impaired persons, it need not be so limited. Persons not visually handicapped may also utilize a tactile version by being blindfolded and thereby be further challenged in playing of the game. This mode of playing has the further educational benefit of providing sighted persons with the experience of visual impairment.

While the two embodiments of this invention that have been shown and described are illustrated as having specific indicia, it will be understood that other and different types and kinds of indicia may be employed in other embodiments of the invention. For example, in place of solid geometric shapes, line-type elements may be utilized to provide an indicia series. Similarly, two color arrangements may be utilized with each of the indicia series being defined by a plurality of different colors with the combinations then being utilized to define the respective playing spaces. Also, graphical illustrations or threedimensional depictions of animals or plants or other structures may be employed in forming the diverse indicia of an indicia series. The playing spaces would then be formed with combinations of the different indicia included in the respective indicia series. The game apparatus can be modified in such respects in many different manners to provide a game having different interests and features as well as greater complexity. However, it must be recognized that the complexity of the game must be designed in accordance within the age and ability characteristics of the participants to which a specific game apparatus may be directed.

Each of the two embodiments of this invention that have been illustrated and described have two indicia series with each playing space thus defined by the two factors. A board game apparatus embodying the concepts of this invention may be designed to have three or more indicia series resulting in each playing space being defined by a number of factors equal to the number of indicia series. The number of indicia selector devices would be increased to have one selector device for each indicia series. Each of the indicia series in the two illustrated embodiments has three diverse indicia, but their number may be increased recognizing that such increase, as would an increase in the number of indicia series, increase the complexity of the game. The number of indicia in each series also need not be the same. With a cubic die selector, six diverse indicia may be readily accommodated in each indicia series. Use of a die having more than six faces would permit a similar increase in the number of indicia in a series. A spinner-type selector device can be readily designed to accommodate a large number of indicia. Combinations of different types of random indicia selector devices, such as both a die and a spinner, may be utilized in a single game apparatus.

Utilization of two different indicia series in each of the two previously described embodiments has included use of two separate devices, one for each indicia series, for effecting the random selection of the two indicia that determine the playing space to which a player's playing piece is to be moved. This requires that the player, after rolling the two die, then perform the mental function of correlating the two selected indicia so as to identify the playing space. While this may seem to be a simple task, it is not simple to relatively young children or to those with learning disabilities.

Consequently, to better adapt this inventive game apparatus to playing by relatively young children and those with comparable mental ability, another embodiment has been devised to eliminate the indicia correlating operation that is required with two separate and independently functioning random indicia selectors. This third embodiment utilizes a game board and playing pieces such as, for example, the visual type shown in FIGS. 1–3, but the random indicia selection means comprises a plurality of selector devices that may be in the form of card-like elements with exemplary embodiments 35, 36, 37 thereof shown in FIG. 9. Each of these elements consists of a rectangularly-shaped sheet of relatively stiff paperboard having a respective playing space identifier 35*a*, 36*a*, 37*a* printed on one face of the card. The other side of the card is without any identifying indicia, although it may be provided with graphic designs for purposes of ornamentation. Each of the identifiers 35*a*, 36*a*, 37*a* consists of a combination of one indicia from each of the two indicia series and thus has the same visual appearance as the playing space that it serves to identify.

Figure 9:
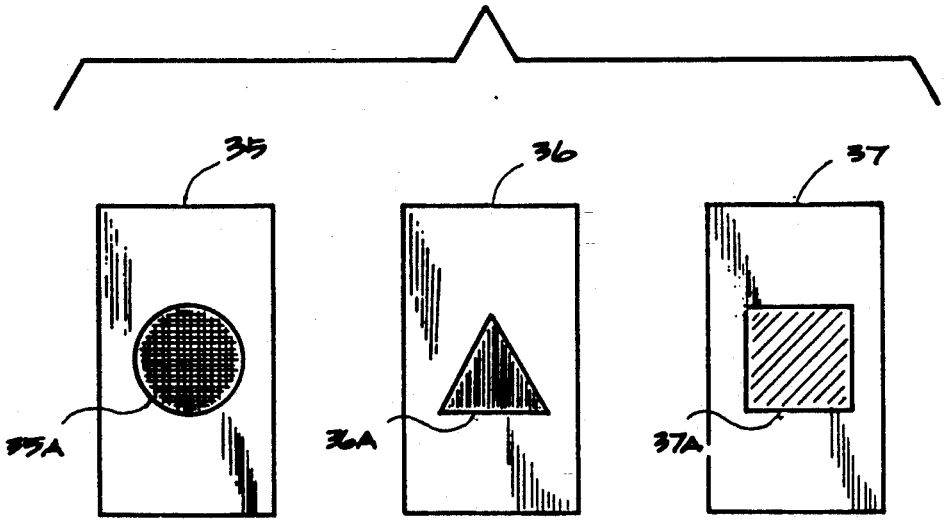
FIG. 9 is a plan view of three selection elements for a third embodiment of the invention.

The three illustrative devices shown in FIG. 9 have identifiers 35*a*, 36*a*, 37*a* formed from the indicia combinations of geometric shapes of circle, triangle and square of the one indicia series with the colors yellow, red and blue, respectively, of the other indicia series. The three devices are illustrative as it will be understood that with three diverse indicia in each of the two indicia series, there are nine different combinations and, accordingly, there will be at least one set of nine of the selector cards. However, in a typical game apparatus embodying this version of the invention, there would be at least two, if not three or four, sets of the nine different cards forming a group of the cards from which each player in turn will draw a card in performing the random selection of the playing space to which his playing piece is to be advanced. The group of cards will be placed on a surface of a table with the identifier face downward, either in a flat or stacked arrangement.

These selector devices 35, 36, 37 thus perform the function of correlating the two indicia factors that define a respective playing space, thereby simplifying the game, although the game still functions in the same manner. One diverse indicia from each of two indicia series determines the playing space to which a playing piece is to be advanced and it is determined through a random selection process. This modification, which provides correlation of the indicia from the two indicia series, may also be provided in a tactile version with similar functioning selection devices of card-like form.

It is readily apparent that a novel and particularly advantageous board game apparatus is provided by this invention. The concept of a dual set of indicia series each having a plurality of diverse indicia results in a unique technique of identifying the playing spaces to which a player may advance his playing piece. This concept requires only a simple comparison of two factors by the player to determine the space to which the playing piece may be advanced, thus making this board game apparatus particularly adapted to young children as well as those with learning disabilities. The tactile version of this game apparatus is particularly advantageous for those same children who may also be visually impaired.

Having thus described this invention, what is claimed is:

1. A board game apparatus comprising a game board having a playing surface with an elongated pathway formed on said surface and over which playing pieces are advanced from a starting point to an end point in the course of playing of the game, said pathway including a plurality of playing spaces distributed in serial relationship between said starting and end points over which playing pieces are incrementally advanced, each of said playing spaces defined by at least two discrete indicia that are each selected from a respective one of at least two indicia series, each of said indicia series including a plurality of diverse indicia with the indicia in each series being distinguishable from all indicia in each of the other series, a playing piece for each player participating in a game with each piece identifiable with a respective player, each playing piece movable along said pathway to a particular playing space for recording the player's progress, and indicia selection means operable by a player for effecting random selection of a playing space to which the player is to advance his playing piece, said indicia selection means operable to identify the selected playing space by an indicia from each of said indicia series and including a separate and independently operable indicia selector device for each indicia series to identify the selected playing space by an indicia from each of said indicia series.

2. A game apparatus according to claim 1 wherein said indicia of each of said indicia series are visually perceptible.

3. A game apparatus according to claim 1 wherein said indicia of each of said indicia series are of a physical configuration to enable tactile perception thereof.

4. A game apparatus according to claim 1 wherein each of said indicia selector devices has one of each of the indicia from a respective indicia series.

5. A game apparatus according to claim 1 wherein each of said indicia selector devices for each indicia series includes a plurality of sheet-form elements that each have a face surface provided with a respective one of said indicia of that indicia series, each player at a respective turn of play drawing an element at random from each of a group of a plurality of said elements associated with each respective indicia series, all of said elements initially disposed with the indicia carrying faces thereof hidden from view.

6. A game apparatus according to claim 1 wherein each of said playing spaces includes an indicia selected from one of said indicia series and an indicia selected from another of said indicia series with the one indicia disposed in superposed relationship to the other.

7. A game apparatus according to claim 1 wherein each of said playing pieces is of a physical configuration to enable tactile identification thereof.

8. A game apparatus according to claim 1 wherein at least some of the playing spaces defined by indicia from each of said indicia series are interpositioned between playing spaces that are each defined by different indicia from each of said indicia series.

9. A game apparatus according to claim 1 wherein each of said indicia series includes at least three diverse indicia.

10. A game apparatus according to claim 1 wherein said pathway includes retention means for mechanically cooperating with said playing pieces to maintain them in the position to which they are placed adjacent the serially disposed playing spaces in supported relationship on the playing surface of said game board, said retention means operable to prevent sliding displacement of said playing pieces over the surface of a said game board in a direction laterally with respect to the longitudinal axis of said pathway.

11. A board game apparatus comprising a game board having a playing surface with an elongated pathway formed on said surface and over which playing pieces are advanced from a starting point to an end point in the course of playing of the game, said pathway including a plurality of playing spaces distributed in serial relationship between said starting and end points over which playing pieces are incrementally advanced, each of said playing spaces defined by at least two discrete indicia that are each selected from a respective one of at least two indicia series, each of said indicia series including a plurality of diverse indicia with the indicia in each series being distinguishable from all indicia in each of the other series, a playing piece for each player participating in a game with each piece identifiable with a respective player, each playing piece movable along said pathway to a particular playing space for recording the player's progress, and indicia selection means operable by a player for effecting random selection of a playing space to which the player is to advance his playing piece, said indicia selection means operable to identify the selected playing space by an indicia from each of said indicia series and including a respective selector device associated with each indicia series, each of said selector devices provided with one of each of the diverse indicia of a respective one of said indicia series and selectively operable to effect functioning thereof in effecting random selection of one of the diverse indicia whereby the combination of indicia determined by each of said selector devices establish the space along said pathway to which a player's playing piece is to be advanced.

12. A game apparatus according to claim 11 wherein said first and second selector devices are of cubical configuration having one of each of the indicia of a respective indicia series applied to respective faces thereof.

13. A board game apparatus comprising a game board having a playing surface with an elongated pathway formed on said surface and over which playing pieces are advanced from a starting point to an end point in the course of playing of the game, said pathway including a plurality of playing spaces distributed in serial relationship between said starting and end points over which playing pieces are incrementally advanced, each of said playing spaces defined by at least two discrete indicia that are each selected from a respective one of two indicia series, each of said indicia series including a plurality of diverse indicia with the indicia in each series being distinguishable from all indicia in each of the other series, said pathway including guide means extending in parallel relationship to the serially disposed playing spaces and disposed in laterally offset relationship thereto, said guide means formed on said game board surface and of a physical configuration to enable its tactile sensing by a player to facilitate following of said pathway, a playing piece for each player participating in a game with each piece identifiable with a respective player, each playing piece movable along said pathway to a particular playing space for recording the player's progress, and indicia selection means operable by a player for effecting random selection of a playing space to which the player is to advance his playing piece, said indicia selection means operable to identify the selected playing space by an indicia from each of said indicia series and including a separate and independently operable indicia selector device for each indicia series to identify the selected playing space by an indicia from each of said indicia series.

14. A game apparatus according to claim 13 wherein said guide means includes an upstanding projection extending a distance upwardly from said game board's playing surface.

15. A game apparatus according to claim 14 wherein said upstanding projection is an elongated rib extending the length of said pathway from said starting point to said end point.

16. A board game apparatus comprising a game board having a playing surface with an elongated pathway formed on said surface and over which playing pieces are advanced from a starting point to an end point in the course of playing of the game, said pathway including a plurality of playing spaces distributed in serial relationship between said starting and end points over which playing pieces are incrementally advanced, each of said playing spaces defined by at least two discrete indicia that are each selected from a respective one of at least two indicia series, each of said indicia series including a plurality of diverse indicia with the indicia in each series being distinguishable from all indicia in each of the other series, said pathway including retention means for mechanically cooperating with said playing pieces to prevent their sliding displacement over the surface of said game board in a direction laterally with respect to the longitudinal axis of said pathway, said retention means including a pair of spaced parallel rails formed on said board playing surface, said rails being laterally spaced apart a distance to receive a base component of said playing pieces and extending the length of said pathway, a playing piece for each player participating in a game with each piece identifiable with a respective player, each playing piece movable along said pathway to a particular playing space for recording the player's progress, and indicia selection means operable by a player for effecting random selection of a playing space to which the player is to advance his playing piece, said indicia selection means operable to identify the selected playing space by an indicia from each of said two indicia series.

17. A game apparatus according to claim 16 wherein said retention means includes indexing means for identifying each playing space and cooperatively forming with said rails a socket to retain a playing piece in association with a respective playing space.

* * * * *